US005804751A

United States Patent [19]

Koseki et al.

[11] Patent Number: 5,804,751

[45] Date of Patent: Sep. 8, 1998

[54] ELECTRONIC MUSICAL INSTRUMENT FOR ELECTRONICALLY GENERATING TONE TOGETHER WITH RESONANT SOUND VARIABLE IN RESPONSE TO PEDAL ACTION

[75] Inventors: Shinya Koseki; Rei Furukawa; Yoshihiro Shiiya, all of Shizuoka, Japan

[73] Assignee: Yamaha Corporation, Japan

[21] Appl. No.: 736,385

[22] Filed: Oct. 24, 1996

[30] Foreign Application Priority Data

Oct. 27, 1995 [JP] Japan ..... 7-280745

[51] Int. Cl.[6] ..... G10H 1/057; G10H 1/08; G10H 7/02

[52] U.S. Cl. ..... 84/604; 84/625; 84/627; 84/630; 84/DIG. 26; 381/63

[58] Field of Search ..... 84/604–607, 622–633, 84/DIG. 26; 381/63–65

[56] References Cited

U.S. PATENT DOCUMENTS

| | | | |
|---|---|---|---|
| 4,909,119 | 3/1990 | Morokuma | 84/DIG. 26 |
| 4,909,121 | 3/1990 | Usa et al. | 84/606 |
| 5,136,916 | 8/1992 | Shibukawa | 84/627 |
| 5,198,604 | 3/1993 | Higashi et al. | 84/626 |
| 5,220,117 | 6/1993 | Yamada et al. | 84/607 |
| 5,256,830 | 10/1993 | Takeuchi et al. | 84/625 |
| 5,498,834 | 3/1996 | Inagaki et al. | 84/622 |

FOREIGN PATENT DOCUMENTS 6-93189 11/1994 Japan .

*Primary Examiner*—Stanley J. Witkowski
*Attorney, Agent, or Firm*—Graham & James LLP

[57] ABSTRACT

In order to change an electronic sound between a piano sound generated without manipulation of a damper pedal and a piano sound generated under manipulation of the damper pedal, an electronic keyboard musical instrument assigns two tone generating channels to a depressed key for generating a fundamental tone signal representative of the piano sound generated by striking the set of strings and a resonating tone signal representative of a resonating sound generated through the resonance, and the resonating sound signal is mixed with the fundamental tone signal under manipulation of a pedal corresponding to the damper pedal, thereby making the electronic sound close to the piano sound.

10 Claims, 7 Drawing Sheets

ELECTRONIC MUSICAL INSTRUMENT FOR ELECTRONICALLY GENERATING TONE TOGETHER WITH RESONANT SOUND VARIABLE IN RESPONSE TO PEDAL ACTION

FIELD OF THE INVENTION

This invention relates to an electronic musical instrument and, more particularly, to an electronic musical instrument for electronically generating a fundamental tone together with a resonant sound variable in response to a pedal action.

DESCRIPTION OF THE RELATED ART

When a player depresses a key forming a part of a keyboard of a piano, a damper head is firstly spaced from a set of strings, and a hammer strikes the set of strings so as to make the set of strings vibrate. The set of strings generates a fundamental tone assigned a note of scale such as "C", "D", "E", . . . or "B". The vibrations of the set of strings cause the piano to generate a resonating sound, and the resonating sound and the fundamental tone form a piano sound.

An electronic keyboard musical instrument can impart various timbres to electronically generated sounds. If a player requests the piano sound to the electronic keyboard musical instrument, the electronic keyboard musical instrument tailors a waveform of a music tone signal representative of the piano sound, and the resonating sound is taken into account.

A typical example of the electronic keyboard musical instrument for generating the piano sound is disclosed in Japanese Patent Publication of Examined Application No. 6-93189. The prior art electronic keyboard musical instrument imparts the timbre of piano to the electronically generated sound as follows.

A fundamental tone generating means is incorporated in the prior art electronic keyboard musical instrument, and generates a music tone signal representative of the waveform of the fundamental tone specified by a depressed key. Pieces of waveform data information are stored in a memory for the resonating sound, and are read out from the memory for generating the piano sound. The pieces of waveform data information represent harmonic tones of the fundamental tone specified by a depressed key, and form a resonating sound signal. The resonating sound signal is supplied to a sound system in parallel to the music tone signal, and the sound system produces a piano sound from the music tone signal and the resonating sound signal.

However, the prior art electronic keyboard musical instrument does not take the effect of a damper pedal into account.

As known to a person skilled in the art, an acoustic piano has the damper pedal, and a pianist prolongs a piano sound through a manipulation of the damper pedal. Damper heads are provided in association with the sets of strings of the acoustic piano. The damper heads are held in contact with the sets of strings in so far as the keys are staying in the rest position. When the pianist depresses a key, the depressed key spaces the associated damper mechanism from the set of strings on the way from the rest position to the end position, and, thereafter, causes the key action mechanism to rotate the hammer toward the set of strings. The damper head allows the set of strings to vibrate upon the impact of the hammer, and the set of strings and the related strings generate the piano sound. The damper mechanism is brought into contact with the set of strings after release of the depressed key so as to take up the vibrations.

If the pianist steps on the damper pedal, the damper pedal maintains the damper heads at the spaced position, and, accordingly, the damper heads are not brought into contact with the sets of strings after the release of the depressed key. Thus, the damper pedal prolongs the piano sound.

However, the effect of the damper pedal is not limited to the prolongation of the piano sound. While the damper pedal is spacing the damper heads from the strings, the vibration of the struck strings are propagated to related strings, and the related strings strongly resonate with the set of strings struck by the hammer. The vibrations of the related strings emphasizes the harmonic tones of the piano sound directly generated by striking the strings, and the piano sound becomes different from a piano sound generated without the manipulation of the damper pedal. However, the pieces of waveform data information stored in the prior art electronic keyboard musical instrument are determined on the assumption that the damper mechanisms are brought into contact with the strings after the release of the depressed key at all times. For this reason, the prior art electronic keyboard musical instrument can not generate electronically generated sounds exactly corresponding to the piano sounds.

SUMMARY OF THE INVENTION

It is therefore an important object of the present invention to provide an electronic keyboard musical instrument which differently generates electronic sounds under a manipulation of a damper pedal.

To accomplish the object, the present invention proposes to mix waveform data for a resonating sound with waveform data for a fundamental tone when a pedal is manipulated.

In accordance with the present invention, there is provided a musical instrument comprising a first instructing means for generating a first instruction of a generation of a fundamental tone, a second instructing means for generating a second instruction of a generation of a resonant sound resonating with the fundamental tone, a sound generating means for generating an electronic sound from an electric sound signal, and an electronic system connected to the first instructing means, the second instructing means and the sound generating means, and responsive to the first and second instructions for generating the electric sound signal, and the electronic system includes a first waveform memory for storing pieces of first waveform data information representative of the fundamental tone, a second waveform memory for storing pieces of second waveform data information representative of the resonant sound, a first preliminary signal generating means responsive to the first and second instructions for generating a first preliminary signal representative of the fundamental tone modifiable with the second instruction from the pieces of first waveform data information, a second preliminary signal generating means responsive to the first and second instructions for generating a second preliminary signal representative of the resonant sound from the pieces of second waveform data information and prohibited from the second preliminary signal in the absence of the second instruction, and a mixing means for mixing the first preliminary signal with the second preliminary signal for generating the electric sound signal.

BRIEF DESCRIPTION OF THE DRAWINGS

The features and advantages of the electronic musical instrument according to the present invention will be more clearly understood from the following description taken in conjunction with the accompanying drawings in which.

DESCRIPTION OF THE PREFERRED EMBODIMENT

Arrangement of Electronic Keyboard Musical Instrument

Figure 1:
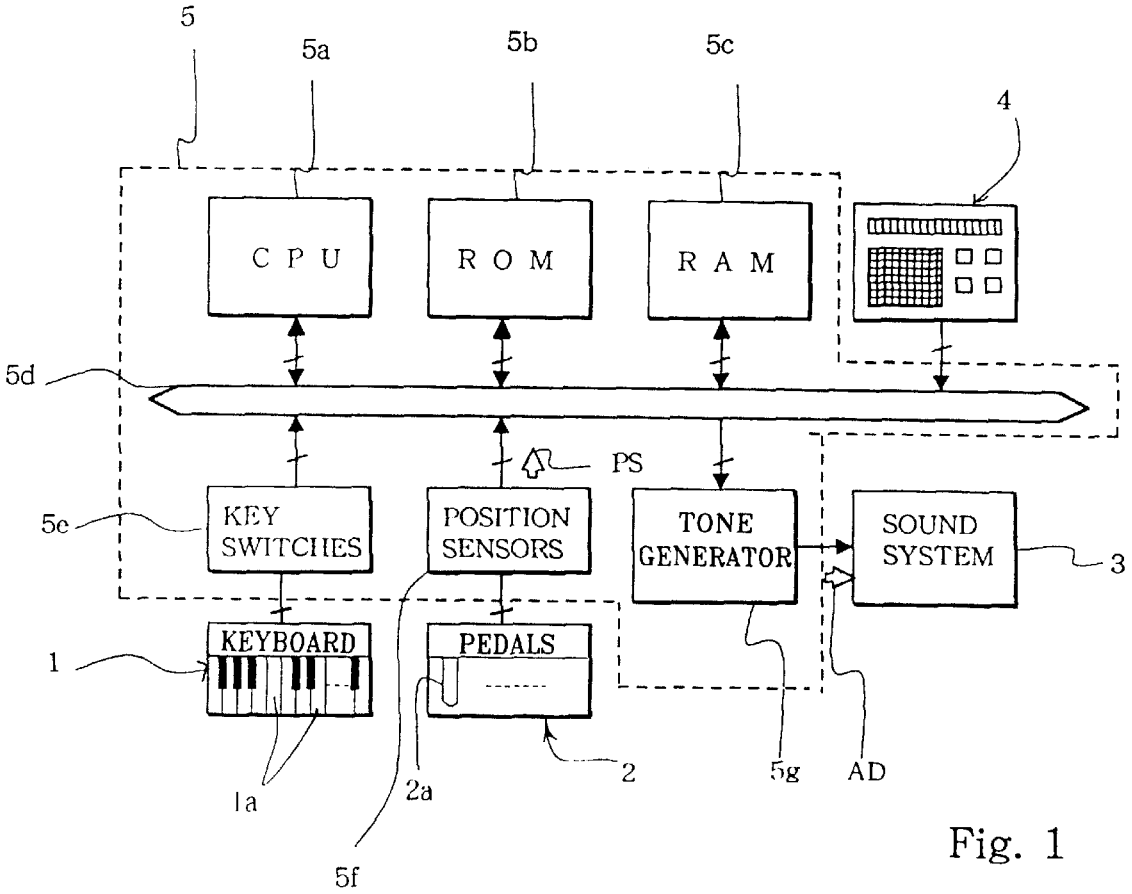
FIG. 1 is a block diagram showing the arrangement of an electronic keyboard musical instrument according to the present invention.

Referring first to FIG. 1 of the drawings, an electronic keyboard musical instrument embodying the present invention largely comprises a keyboard 1, pedals 2, a sound system 3, a manipulating panel 4 and an electronic sound generating system 5 electrically connected to the keyboard 1, the pedals 2, the manipulating panel 4 and the sound system 3. Although these component parts 1 to 5 are accommodated in a case, FIG. 1 only illustrates an electrical connection therebetween.

A plurality of black and white keys 1*a* form in combination the keyboard 1, and are arranged as similar to the keyboard of an acoustic piano. Notes of a scale are respectively assigned to the black and white keys 1*a*, and the black and white keys 1*a* are identified by using key codes KC, respectively. In this instance, eighty-eight keys 1*a* are incorporated in the keyboard 1.

One of the pedals 2*a* is assigned prolongation of electronic sounds, and is, accordingly, corresponding to the damper pedal of the acoustic piano.

The sound system 3 includes a suitable amplifier and speakers. The electronic sound generating system 5 digitally processes pieces of music data information supplied from the keyboard 1 and the pedals 2 in accordance with pieces of tone data information supplied from the manipulating panel 4, and generates an analog audio signal AD. The analog audio signal AD is supplied from the electronic sound generating system 5 to the sound system 3, and the electronic sounds are produced from the analog audio signal AD through the speakers. The audio signal may be supplied through a connector to another electronic musical instrument.

The manipulating panel 4 includes various switches, and are periodically scanned through the shared bus 5*d* by the central processing unit 5*a*. Several switches are assigned to different timbres such as a piano and a harpsichord, and a player selects one of the timbres for electronic sounds. Another switch is available for a volume of the electronic sounds, and a player regulates the volume of the electronic sounds by manipulating the switch.

The electronic sound generating system 5 includes a central processing unit 5*a*, a read only memory 5*b*, a random access memory 5*c* and a shared bus 5*d*, and the central processing unit 5*a*, the read only memory 5*b* and the random access memory 5*c* are abbreviated as "CPU", "ROM" and "RAM", respectively, in FIG. 1. The central processing unit 5*a* communicates with the read only memory 5*b* and the random access memory 5*c* through the shared bus 5*d*. The read only memory 5*b* stores programmed instruction codes, and the central processing unit 5*a* sequentially fetches the instruction codes so as to achieve tasks described hereinlater. Various data are further stored in the read only memory 5*b*, and the data are used in the data processing for the tasks. The random access memory 5*c* serves as a temporary data storage for the central processing unit 5*a*.

The electronic sound generating system 5 further includes key switches 5*e* and a pedal position sensor 5*f*. The key switches 5*e* are respectively connected to the black and white keys 1*a*, and the central processing unit 5*a* sequentially scans the key switches 5*e* to see whether or not a player depresses and releases a key 1*a*. When a key 1*a* is depressed, the central processing unit 5*a* determines the key code KC assigned thereto, and acknowledges a key-on event for the depressed key 1*a*. The central processing unit 5*a* calculates a key velocity, and provides a key-touch code KT representative of the sound intensity of an electronic sound for the depressed key 1*a*. On the other hand, when the player releases the depressed key 1*a*, the central processing unit 5*a* acknowledges a key-off event, and the key-on event and the key-off event give a timing to generate an electronic sound and a timing to extinguish the electronic sound.

The pedal position sensor 5*f* is associated with the pedal 2*a*, and informs a current pedal position PT to the central processing unit 5*a*. When the pedal 2*a* is resting in the uppermost position, the pedal position sensor 5*f* generates a pedal position signal PS representative of the minimum stroke "0". On the other hand, when a player depresses the pedal 2*a* to the lowermost position, the pedal position sensor 5*f* generates the pedal position signal PS representative of the maximum stroke "1". While the pedal 2*a* is traveling from the uppermost position toward the lowermost position, the pedal position sensor 5*f* continuously changes the pedal position signal PS from "0" to "1". For this reason, even if a player maintains the pedal 2*a* at an intermediate position, the pedal position sensor 5*f* detects the intermediate position, and the central processing unit 5*a* exactly discriminates the intermediate position. This feature allows the electronic keyboard musical instrument to impart the effect of a half pedal to the electronic sound.

The selected timbre, the regulated sound intensity, the key-code KC, the key-touch KT, a key status code KON/KOFF representative of the key-on/key-off and a pedal status code representative of the current pedal position PT are represented by music data codes, and a set of music data codes is used for generating an electronic sound.

The electronic sound generating system 5 further includes a tone generator 5*g*, and the central processing unit 5*a* supplies music data codes to the tone generator 5*g* for generating the analog audio signal AD. The tone generator 5*g* successively generates time slots selectively assigned to a plurality of tone generating channels. The music data codes for a depressed key are assigned to two of the tone generating channels, and the tone generator 5*g* tailors a waveform of a tone signal through the tone generating channel for the depressed key 1*a*.

When a player concurrently depresses a plurality of keys 1*a*, the tone generator 5*g* assigns the tone generating channels to the sets of music data codes, and the tone generating channels respectively tailor the waveforms of the tone signals. The tone signals are mixed with one another so as to form the analog audio signal AD, and the analog audio signal AD is supplied from the tone generator 5*g* to the sound system 3.

Arrangement of Tone Generator

Figure 2:
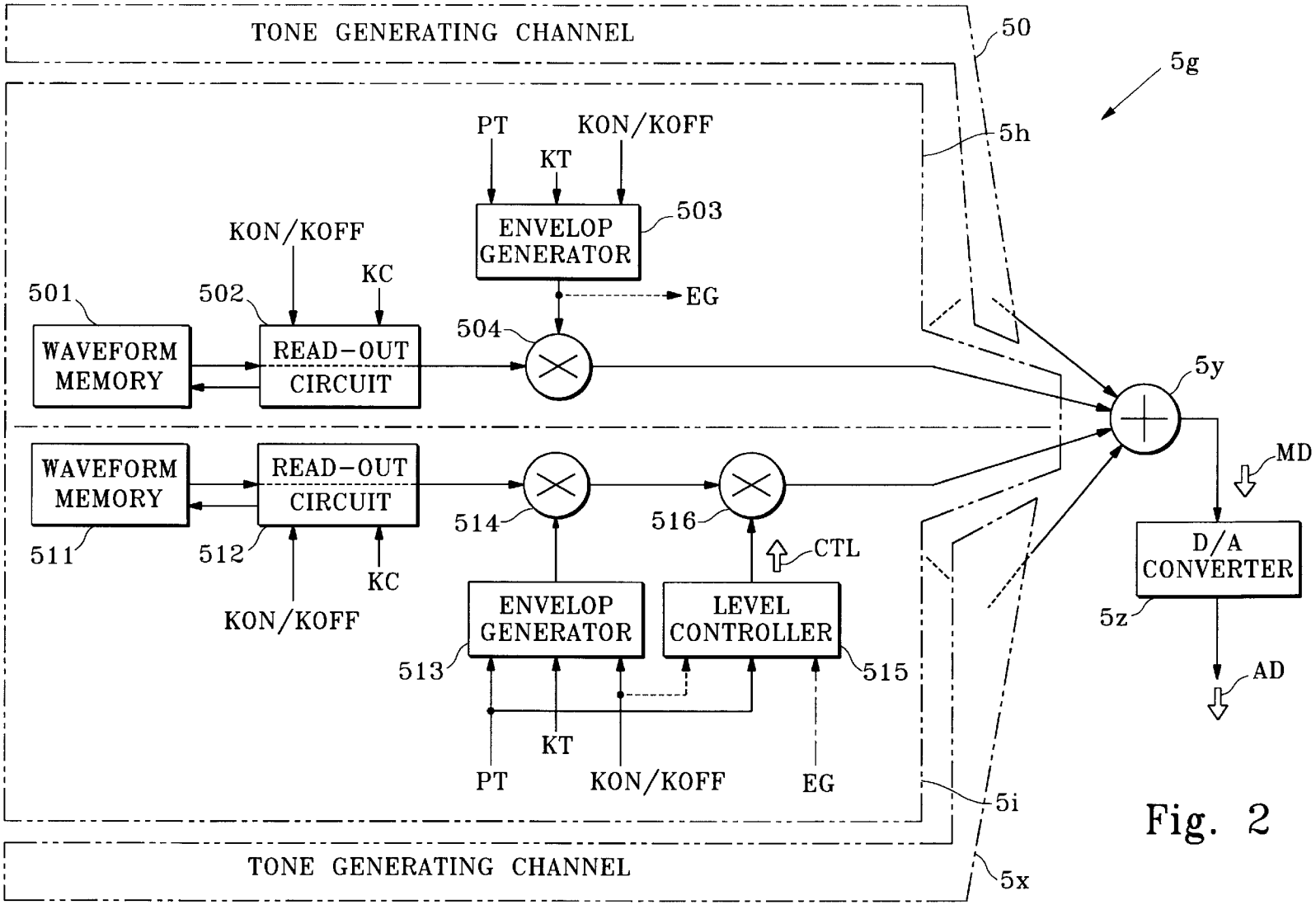
FIG. 2 is a block diagram showing the circuit configuration of a tone generator incorporated in the electronic keyboard musical instrument.

Turning to FIG. 2 of the drawings, the tone generator 5*g* includes a plurality of tone generating channels 50, . . . , 5*h*, 5*i*, . . . and 5*x*, an adder 5*y* and a digital-to-analog converter 5*z*. Every two tone generating channels are paired with each other, and are assigned to a depressed/released key 1*a*. In FIG. 2, only one pair of tone generating channels 5*h*/5*i* are illustrated in detail, and description is focused on the pair of tone generating channels 5*h*/5*i*.

In the following description, term "fundamental tone" means a sound generated by striking a set of strings or the like, and term "resonant sound" means a sound generated by related strings or the like resonating with the vibrations of the set of strings or the like.

The tone generating channel 5*h* includes a waveform memory 501 for fundamental tones, a read-out circuit 502, an envelop generator 503 and a multiplier 504. The multiplier 504 is connected at the input nodes thereof to the waveform memory 501 and the envelop generator 503, and the output node of the multiplier 504 is connected to one of the input nodes of the adder 5*y*.

The waveform memory 501 stores a plurality of groups of waveform data for the various timbres, and a plurality of sets of waveform data representative of the fundamental tones are incorporated in each group for the notes of the scale. Each set of waveform data represents a variation of the waveform from the generation to the extinguishment.

A plurality of sets of waveform data were, by way of example, actually sampled from the fundamental tones generated by an acoustic piano under the same conditions such as a standard key-touch or key velocity, and the damper pedal was not depressed. The plurality of sets of waveform data were normalized so as to eliminate the individuality of the acoustic piano, and were assigned respective starting addresses.

The read-out circuit 502 selects one of the plurality of groups of waveform data on the basis of the selection of the timbre on the manipulating panel 4, and chooses a set of waveform data from the selected group in response to the key code KC. The read-out circuit 502 starts to read out the set of waveform data in response to the key status code KON/KOFF representative of the key-on event, and increments the address of the waveform memory 501 at a read-out rate corresponding to the key code KC. Thus, the read-out circuit 502 causes the waveform memory 501 to output the selected set of waveform data in the form of a digital signal. The waveform reproduced from the set of waveform data is shrunk or elongated at a certain ratio with respect to the basis of the original waveform.

The envelop generator 503 supplies a set of envelop data in the form of a series of digital codes to the multiplier 504, and the envelop generator 503 and the multiplier 504 impart an envelop to the set of waveform data read out from the waveform memory 501. Plots EV1 represent an envelop given to a set of waveform data read out from the waveform memory 501. The envelop generator 503 starts to supply a set of envelop data at the key-on event represented by the key status code KON/KOFF, and enters into a release time at the key-off event represented by the key-off data bit KOFF. The envelop generator 503 changes an attack level depending upon the key velocity represented by the key-touch code KC.

In general, when a player depresses a key of an acoustic piano at high speed, the hammer strongly strikes the strings, and the sound intensity is enlarged. Similarly, if the envelop generator 503 gives a large attack level to the envelop, an electronic sound to be generated has a large sound intensity. For this reason, the envelop generator 503 determines the attack level depending upon the key-touch code KT.

Figure 3A:
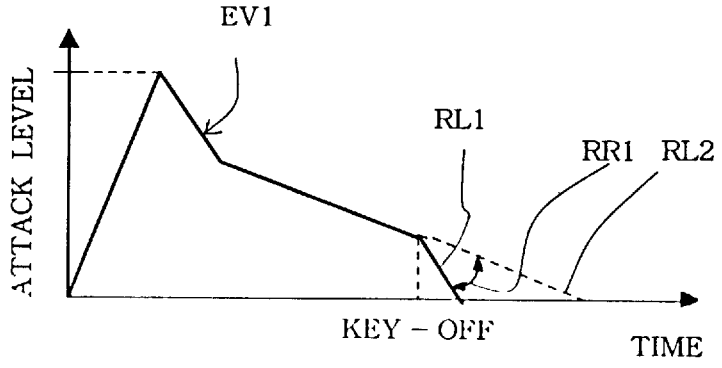
FIG. 3A is a diagram showing an envelop given by a set of waveform data for a fundamental sound.

The envelop generator 503 is further responsive to the current pedal position PT represented by the pedal position signal PS so as to change a release rate RR1 of the envelop EV1 (see FIG. 3A). If a player allows the pedal 2*a* to stay in the uppermost position, the envelop generator 503 and the multiplier 504 rapidly decay the envelop EV1 along real line RL1 as if a damper head is brought into contact with vibrating strings. However, if the player depresses the pedal 2*a* deeper than a certain intermediate position, the envelop generator 503 and the multiplier 504 gently decay the envelop along broken line RL2 as if the damper head is forcibly held off. The release rate RR1 is variable in dependence on the value of the current pedal position PT, and the envelop generator 503 and the multiplier 504 can impart an envelop representative of the half pedal to the set of waveform data.

The tone generating channel 5*i* includes a waveform memory 511 and a read-out circuit 512. The waveform memory 511 is provided for resonating sounds, and stores a plurality of groups of waveform data assigned to the different timbres. A plurality of sets of waveform data are incorporated in each group, and are respectively assigned to the notes of the scale.

In order to obtain the waveform data, piano sound were, by way of example, generated by the acoustic piano under the same conditions, and the damper pedal was fully depressed. Firstly, preliminary waveform data were sampled from the piano sounds. The waveform data components for the fundamental tones were deleted from the preliminary waveform data at all sampling points, and the remaining waveform data components were used as the plurality of sets of waveform data for the resonating sounds. The waveform data for another timbre were obtained as similar to the piano sounds. The waveform data for the resonating sounds were also normalized.

The read-out circuit 512 reads out a set of waveform data from the waveform memory 511 in a similar manner to the read-out circuit 502. The read-out circuit 512 selects one of the plurality of groups of waveform data on the basis of the selection of the timbre on the manipulating panel 4, and chooses a set of waveform data from the selected group in response to the key code KC. The read-out circuit 512 starts to read out the set of waveform data in response to the key status code KON/KOFF representative of the key-on event, and increments the address of the waveform memory 501 at a read-out rate corresponding to the key code KC. The read-out circuit 512 enters into a release time upon reception of the key-off data bit KOFF. The waveform reproduced from the set of waveform data is similar to the original waveform shrunk or elongated at a certain ratio. Thus, the read-out circuit 512 cooperates with the read-out circuit 502, and the set of waveform data for the resonating sound is read out from the waveform memory 511 in synchronization with the set of waveform data for the fundamental tone.

The tone generating channel 5*i* further includes an envelop generator 513, a multiplier 514, a level controller 515 and a multiplier 516. The multiplier 514 is connected at the input nodes thereof to the waveform memory 511 and the envelop generator 513, and the other multiplier 516 is connected at the input nodes thereof to the multiplier 514 and the level controller 515. The output node of the multiplier 516 is connected to the adder 5*y*.

Figure 3B:
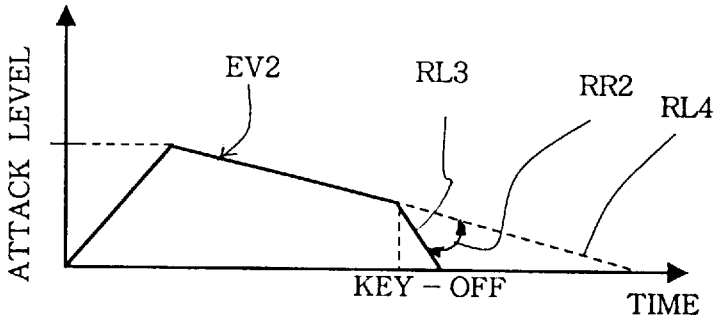
FIG. 3B is a diagram showing an envelop given by a set of waveform data for a resonant sound.

The envelop generator 513 supplies a set of envelop data to the multiplier 514 in response to the key motion, i.e., the key status code KON/KOFF representative of the key-on event and the key-off event. The set of envelop data is supplied to the multiplier 514 in the form of a series of digital code. The multiplier 514 gives an envelop EV2 to the set of waveform data as shown in FIG. 3B. The envelop generator 513 is responsive to the key-touch code KT so as to regulate the attack level as similar to the envelop generator 503. The current pedal position PT is also supplied to the envelop generator 513, and the envelop generator 513 changes the release rate RR2 depending upon the current pedal position PT. If no force is applied to the pedal 2*a*, the envelop generator 513 and the multiplier 514 rapidly decays the envelop EV2 along real line RL3. On the other hand, if the pedal 2*a* is depressed deeper than the certain position, the envelop generator 513 prolongs the release time as indicated by broken line RL4. Thus, the envelop generator 513 controls the envelop EV2 of the set of waveform data for the resonating sound as similar to the envelop generator 503.

The key status code representative of the key-on event enables not only the read-out circuit 502 but also the read-out circuit 512, and a set of waveform data for the fundamental tone and the associated set of waveform data for the resonating sound are respectively read out from the waveform memories 501 and 511 in synchronism with the each other. However, if a damper pedal of an acoustic piano is not depressed, the damper heads are held in contact with related strings during the strike at a set of strings, and the related strings do not generate a resonating sound. Similarly, if the pedal 2*a* is not depressed, the electronic sound should be prohibited from the set of waveform data for the resonating sound. For this reason, the level controller 515 regulates the set of waveform data for the resonating sound to an appropriate value corresponding to the pedal stroke or the current pedal position PT.

Figure 4:
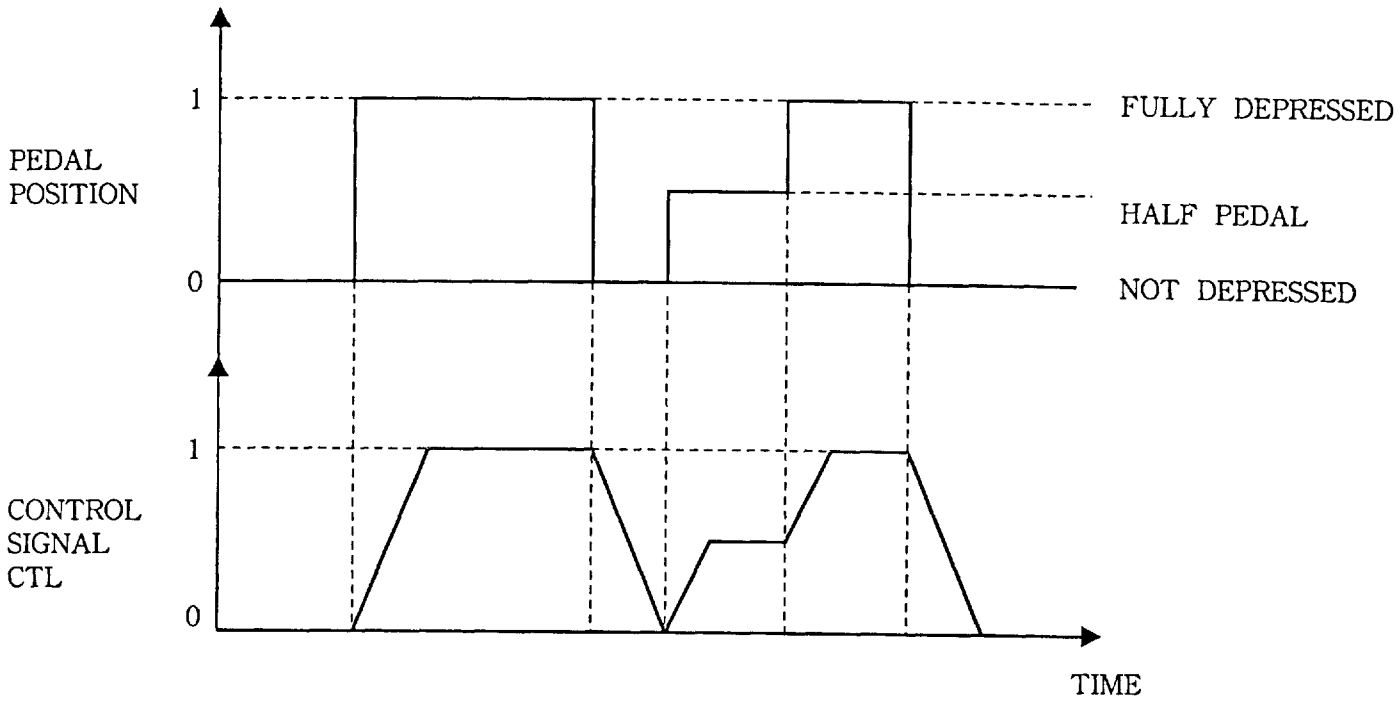
FIG. 4 is a graph showing the relation between a pedal position and a control signal.

FIG. 4 illustrates the relation between the pedal position and the value of a control signal CTL supplied from the level controller 515 to the multiplier 516. The pedal position is varied between value "0" and value "1", and the control signal CTL also changes the value between "0" and "1". Although the pedal 2*a* sharply changes the pedal position, the increment and the decrement of the control signal CTL are smaller than those of the pedal position.

If the waveform data for the fundamental tone are suddenly mixed with and blocked from the waveform data for the resonating sound, a noise tends to take place in the electronic sounds. The level controller 515 integrates or interpolates the current pedal position PT for the gentle variation of the value of the control signal CTL, and the gentle variation of the control signal CTL eliminates noise from the electronic sounds.

The level controller 515 supplies the control signal CTL to the multiplier 516, and the product between the waveform data and the envelop data is multiplied by the value of the control signal CTL. If value of the control signal CTL is small, the multiplier 516 does not transfer the output signal of the multiplier 514 to the adder 5*y*. On the other hand, if the value of the control signal CTL is large, the multiplier 516 transfers the output signal of the multiplier 514 to the adder 5*y*. However, the transition is mild, and no noise component is mixed into a digital music sound signal MD representative of the electronic sound.

Thus, the tone generating channel 5*i* identifies a set of waveform data for a resonating sound, reads out the set of waveform data, imparts an envelop to the set of waveform data, and decides whether to transfer the waveform data to the adder 5*y* or not.

Figure 5:
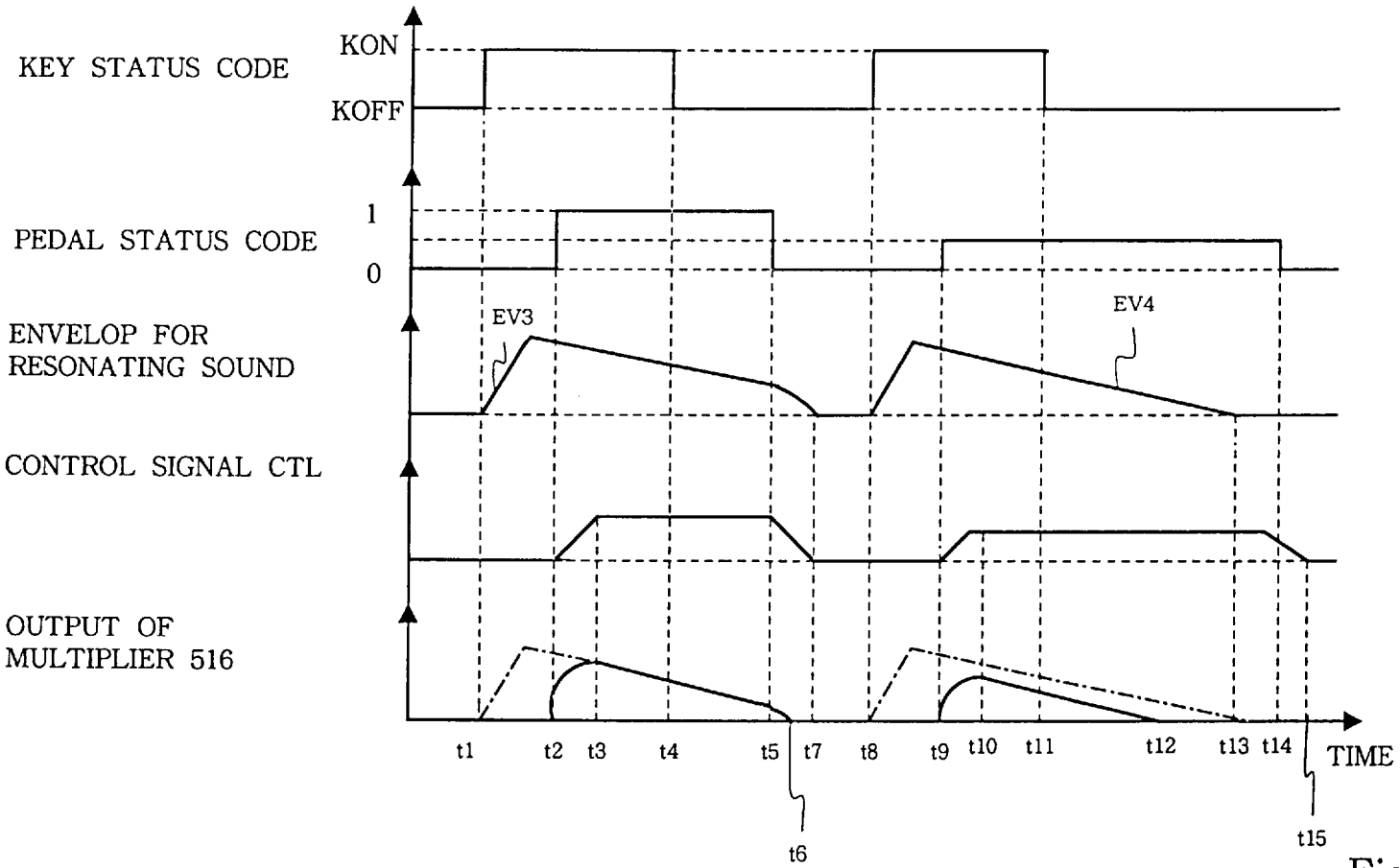
FIG. 5 is a diagrams showing a function of a tone generating channel for a resonating sound.

FIG. 5 illustrates the function of the tone generating channel 5*i*. Assuming now that a key 1*a* is depressed between time t1 and time t4, the multiplier 514 gives an envelop EV3 to a set of waveform data for a resonating sound read out from the waveform memory 511 between time t1 and time t7. If the pedal 2*a* is depressed between time t2 and time t5, the level controller increases the value of the control signal CTL from time t2 to time t3, and decreases the value of the control signal CTL from time t5 to time t7. The amplitude of the envelop EV3 is multiplied by the value of the control signal CTL, and the multiplier 516 raises the output signal thereof from time t2 to time t3, and the gradient of the output signal is matched with the envelop EV3 at time t3. Although the key 1*a* is released at time t4, the pedal 2*a* prolongs the electronic sound until time t6 as if a damper pedal is depressed. The multiplier 516 rapidly decays it from time t5 to time t6, because the pedal 2*a* is recovered to the uppermost position at time t5. Thus, the pedal motion gently affects the output signal (compare the pedal status code with the output of the multiplier 516).

On the other hand, if the pedal 2*a* is maintained at the intermediate position between time t9 and time t15, the level controller 515 prolongs the output signal of the multiplier 516 after the release of the key 1*a*. The pedal 2*a* returns to the uppermost position after the recovery of the envelop EV4 at time t13, and the multiplier 516 gently decays the output signal.

The adder 5*y* adds the output signal of the multiplier 516 to the output signal of the multiplier 504, and generates the digital music sound signal MD. The digital-to-analog converter 5*z* converts the digital music sound signal MD to the analog audio signal AD, and the analog audio signal AD is supplied to the sound system 3.

If a player depresses more than one key 1*a*, the music data codes for each depressed key are supplied to a pair of tone generating channels such as 5*h* and 5*i*, and the pairs of tone generating channels behave as similar to the above described pair of tone generating channels 5*h*/5*i*. The adder 5*y* add the output signals of the pairs of tone generating channels together so as to generate the digital music sound signal MD.

Although the tone generating channel 5*i* is used for the data processing for the resonating sound, the tone generating channel 5*i* is identical with the tone generating channel 5*i* except for the level controller 515 and the multiplier 516. For this reason, if the control signal CTL is fixed to "1" and the waveform data for the fundamental tones are stored in the waveform memory 511, the tone generating channel 5*i* is available for generation of a fundamental tone.

Behavior of the Electronic Keyboard Musical Instrument

Figure 6:
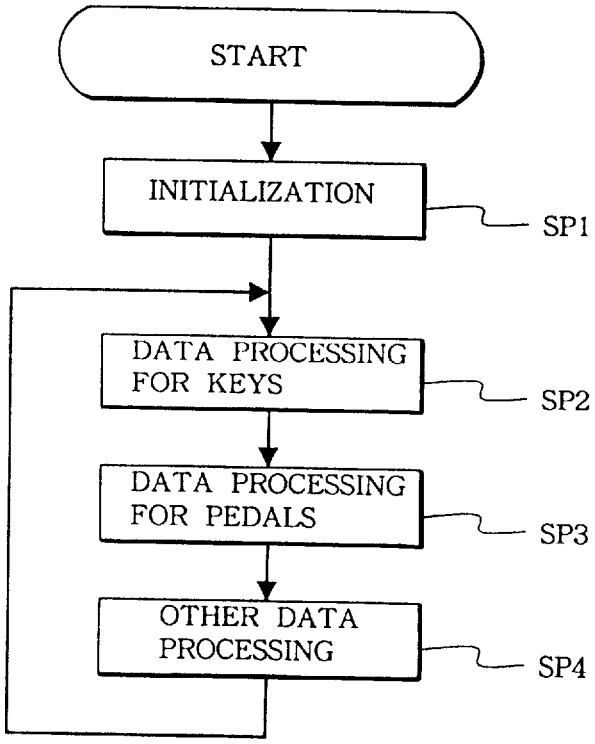
FIG. 6 is a flow chart showing the program sequence of a main routine executed by the electronic keyboard musical instrument.
Figure 7:
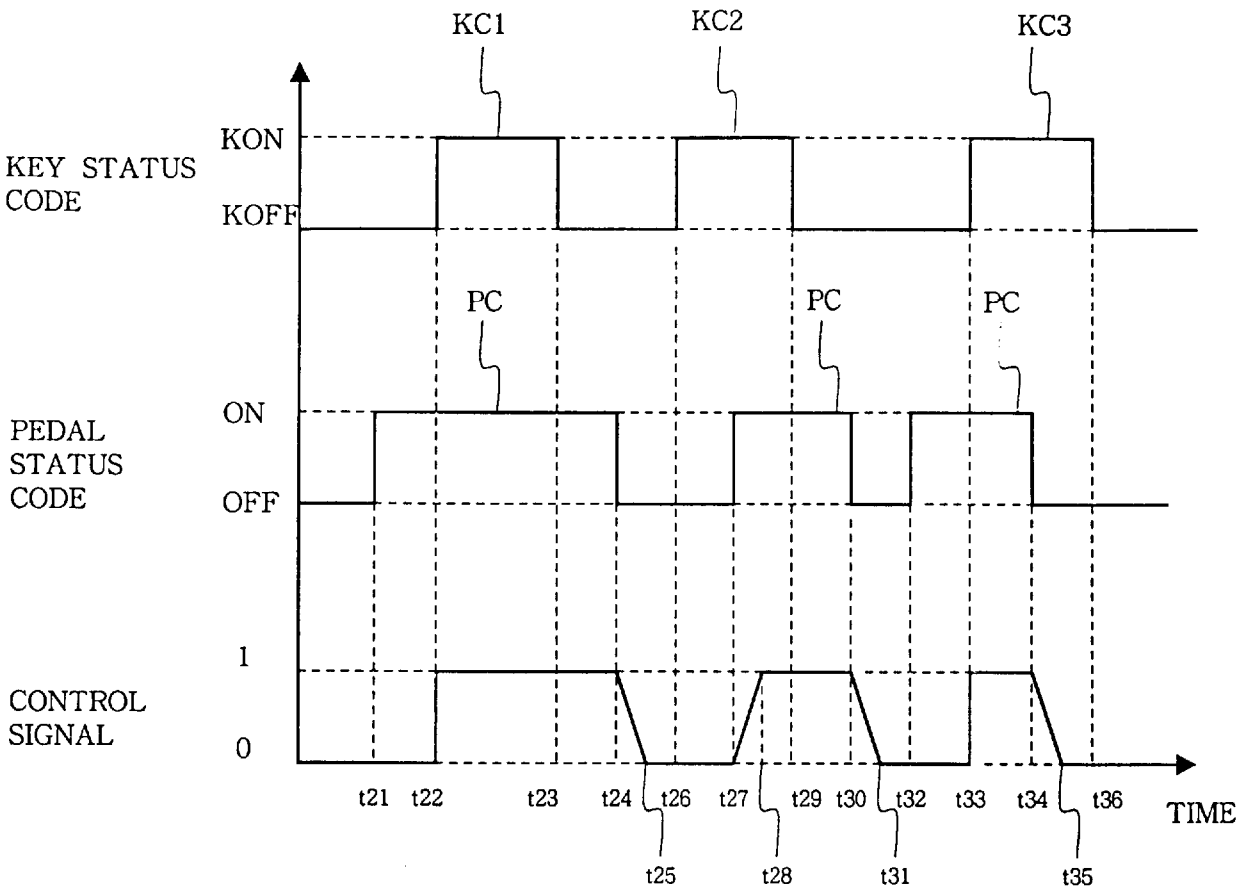
FIG. 7 is a diagram showing the circuit behavior of a tone generator incorporated in the electronic keyboard musical instrument.

Description is made on the behavior of the electronic keyboard musical instrument with reference to FIGS. 6 and 7. When the keyboard musical instrument is powered, the central processing unit 5*a* firstly initializes the electronic sound generating system 5 as by step SP1. An area is assigned as the working memory, and is cleared. The central processing unit 5*a* sets selectable conditions such as the volume and the timbre default options.

Upon completion of the initialization, the central processing unit 5*a* proceeds to step SP2, and sequentially checks the key switches 5*e* to see whether or not a key 1*a* changes the key status, i.e., from the key-off status to the key-on status and vice versa.

If one of the key switches 5*e* detects a change from the key-off status to the key-on status, the central processing unit 5*a* determines the key code KC and the key-touch for the depressed key 1*a*, and generates the music data codes from these pieces of key status information. The central processing unit 5*a* assigns a pair of tone generating channels in open status to the music data codes. If all of the tone generating channels are busy, the central processing unit 5*a* looks for a pair of tone generating channels closest to the end of the tone generation or a pair of tone generating channels assigned to the music data codes representative of the smallest volume at the earliest timing, and cancels the assignment so as to forcibly change the pair of tone generating channels to the open status. In this way, the central processing unit 5*a* assigns a pair of tone generating channels to the music data codes generated for the newly depressed key 1*a*.

On the other hand, if one of the key switches 5*e* finds a change from the key-on status to the key-off status, the central processing unit 5*a* generates the music data code representative of the key-off status, and supplies it to the pair of tone generating channels already assigned to the depressed key 1*a*.

When the central processing unit checks all the key switches and completes the generation of the music data codes and the assignment of the tone generating channels, the central processing unit 5*a* proceeds to step SP3. If the central processing unit 5*a* does not find any change of the key status, the central processing unit 5*a* immediately proceeds to step SP3.

The central processing unit 5*a* checks the position sensors 5*f* to see whether or not a player changes the pedal position of one of the pedals 2 in step SP3.

If the player depressed the pedal 2*a*, the associated position sensor 5*f* has already supplied the pedal position signal PS representative of the current pedal position PT to the central processing unit, and the central processing unit 5*a* fetches the pedal position signal PS. The central processing unit acknowledges the pedal-on event for the pedal 2*a*, and generates the music data code representative of the pedal-on event and the current pedal position PT. The central processing unit 5*a* supplies the music data code to the tone generating channels 50 to 5*x*, and causes the tone generating channels 50 to 5*x* to supply the waveform data for the resonating sound or sounds to the adder 5*y*.

On the other hand, if the position sensor 5*f* for the pedal 2*a* decreases the current pedal position PT to a small value representative of the pedal-off event, the central processing unit 5*a* supplies the music data code representative of the pedal-off event and the current pedal position PT to the tone generating channels 50 to 5*x*, and the tone generating channels 50 to 5*x* increases the release rates RR1 and RR2 so as to rapidly terminate the electronic sound or sounds.

When the central processing unit 5*a* completes the data processing for the pedals 2, the central processing unit 5*a* proceeds to step SP4. If the central processing unit 5*a* does not find any change of current pedal position, the central processing unit 5*a* proceeds to step SP4 without the data processing.

The central processing unit carries out other data processing in step SP4. For example, the central processing unit 5*a* checks all the keys on the manipulating panel 4 to see whether or not a player changes a selection such as the volume or the timbre. If the player manipulates a key on the manipulating panel 4, the central processing unit 5*a* determines the key manipulated by the player, and changes the status data representative of the selection.

Upon completion of the other data processing, the central processing unit 5*a* returns to step SP2, and reiterates the loop consisting of steps SP2 to SP4 until the electronic keyboard musical instrument is cut off from the power source. If there is not data processing at step SP4, the central processing unit 5*a* immediately returns to step SP2.

While the central processing unit 5*a* is carrying out the data processing in steps SP2 and SP3, the tone generator 5*g* behaves as follows. As described hereinbefore, the tone generating channels 50 to 5*x* are incorporated in the tone generator 5*g*, and achieve tasks in a time sharing manner during a single sampling period. Namely, each tone generating channel is assigned a time slot in each sampling period, and outputs the waveform data for the fundamental tone or the resonating sound. The tone generating channels supply the waveform data to the adder 5*y* during each sampling period, and the adder 5*y* adds the waveform data for generating the digital music sound signal MD in each sampling period. The digital music sound signal MD is converted to the analog audio signal AD, and the sound system 3 generates the piano sound from the audio signal.

The waveform data for the resonating sound are read out from the waveform memory 511 of each tone generating channel already assigned regardless of the current pedal position PT. Although the read-out from the waveform memory 511 is not strictly concurrent with the read-out from the waveform memory 501 of the associated channel because of different time slots assigned thereto, the waveform data for the resonating sound and the waveform data for the fundamental tone are substantially concurrently supplied from the waveform memories 501 and 511, and the adder 5*y* exactly overlaps the envelop of the waveform data for the resonating sound with the envelop of the waveform data for the fundamental tone. For this reason, the fundamental tone and the resonant sound maintain the phase relation therebetween, and the manipulation of the pedal 2*a* exactly imparts the resonant effect to the electronic sounds.

FIG. 7 illustrates the phase relation between the fundamental tones and the resonating sounds. The keys 1*a* are selectively depressed between time t22 and time t23, time t26 and time t29 and time t33 and time t36, and, accordingly, the key status codes KC1, KC2 and KC3 change the key status at times t22, t23, t26, t29, t33 and t36. On the other hand, the pedal 2*a* is depressed at times t21, t27 and t32, and is released at times t24, t30 and t34. Accordingly, the pedal status code PC changes the pedal status at times t21, t24, t27, t30, t32 and t34.

In this situation, the level controllers 515 of the tone generating channels assigned to the depressed keys 1*a* starts to change the control signals CTL from zero to one at times t22, t27 and t33 so as to impart the resonant effect to the electronic sounds.

As to the electronic sound represented by the key status code KC1, the pedal 2*a* has been changed to the pedal-on status before the key-on event, and the resonant effect is immediately given to the electronic sound.

On the other hand, the pedal 2*a* is depressed during the key-on status of the key 1*a* represented by the key status code KC2. Then, the tone generating channel gradually gives the resonant effect to the electronic sound, and prolongs the electronic sound until time t31. The decay of the electronic sound is gentle.

In case where the pedal 2*a* is released during the key-on status of the key 1*a* represented by the key status code KC3, the tone generating channel gradually removes the resonant effect from the electronic sound before the change from the key-on status to the key-off status at time t36.

Thus, the electronic keyboard musical instrument according to the present invention exactly imparts the resonant effect to the electronic sounds as if the player performs an acoustic musical instrument.

The tone generator 5*g* allows the tone generating channels 50 5*x* to prepare the waveform data for the resonating sounds regardless of the pedal status code, and imparts the resonant effect to the electronic sounds by changing the value of the control signals CTL in response to the manipulation of the pedal 2*a*. This results in a simple controlling sequence rather than a tone generating channel generating the waveform data for the resonating sound in the co-presence of the key status code representative of the key-on event and the pedal status code representative of the pedal-on event.

Moreover, the tone generating channels change the release rates RR1 and RR2 depending upon the stroke of the pedal 2*a*, and the electronic sounds are decayed as similar to the piano sounds generated by an acoustic piano without and under manipulation of the damper pedal.

In this instance, the keyboard 1, the pedal 2*a* and the sound system 3 serve as a first instructing means, a second instructing means and a sound generating means. The waveform memories 501 and 511 respectively serve as a first waveform memory and a second waveform memory. The read-out circuit 502, the envelop generator 503 and the multiplier 504 as a whole constitute a first preliminary signal generating means, and the read-out circuit 512, the envelop generator 513, the level controller 515 and the multipliers 514 and 516 form in combination a second preliminary signal generating means. The adder 5*y* serves as a mixing means.

Although particular embodiments of the present invention have been shown and described, it will be obvious to those skilled in the art that various changes and modifications may be made without departing from the spirit and scope of the present invention.

For example, the central processing unit 5*a* may supply the music data codes through a suitable interface to another electronic musical instrument.

The key status code KON/KOFF may be supplied to the level controller 515 so as to maximize the resonant effect immediately after the key-on event. In the above described embodiment, the level controller 515 changes the values of the control signal CTL depending upon the pedal stroke represented by the current pedal position PT. If a key 1*a* is depressed immediately after a player steps on the pedal 2*a*, the control signal CTL has not reached the maximum value "1", yet, and the tone generating channel can not maximize the resonant effect. However, if the key status code KON/KOFF is supplied to the level controller as indicated by broken lines in FIG. 2, the level-controller can maximize the value of the control signal CTL immediately after the key-on event, and the resonant effect of the electronic sound is maximized as similar to the piano sound generated under the manipulation of the damper pedal.

The level controller 515 may increase the value of the control signal CTL depending upon a calculation result between the pedal stroke and time interval from a key-on event to a pedal-on event so as to further make the electronic sound closer to the acoustic piano sound generated under the same conditions.

The level controller 515 may increase the value of the control signal CTL depending upon a calculation result between the pedal stroke and the value EG of the envelop data as indicated by broken line in FIG. 2 when the pedal 2*a* is depressed after a key-on event. This results in further improvement in fidelity of the electronic sound, and the quality of the electronic sound becomes like that of the acoustic piano.

The above described embodiment, the level controller 515 generates the control signal CTL through the interpolation on the current pedal position PT. Another level controller may control the gradient or the velocity of interpolation depending upon time interval from the key-on event to the pedal-on event.

The waveform data for the resonating sound may be different depending upon the key-touch KT.

The electronic sound generating system according to the present invention is available for another kind of musical instrument such as a silent piano disclosed in U.S. Pat. No. 5,374,775, an electronic wind instrument or an electronic percussion instrument.

The keys of a keyboard may be divided into key groups, and the waveform data for the resonant sound and the waveform data for the fundamental tone may be stored for each of the key groups.

What is claimed is:

1. A musical instrument comprising:

a first instructing means for generating a first instruction of a generation of a fundamental tone;

a second instructing means for generating a second instruction of a generation of a resonant sound resonating with said fundamental tone;

a sound generating means for generating a sound from an electric sound signal; and an electronic system connected to said first instructing means, said second instructing means and said sound generating means, and responsive to said first and second instructions for generating said electric sound signal, said electronic system including:

a first waveform memory for storing pieces of first waveform data information representative of said fundamental tone and produced from a first acoustic tone corresponding to said fundamental tone and generated by using an acoustic musical instrument without manipulating a manipulator corresponding to said second instructing means, a second waveform memory for storing pieces of second waveform data information representative of said resonant sound and produced from a difference between said first acoustic tone and a second acoustic tone generated by using said acoustic musical instrument under manipulation of said manipulator, a first preliminary signal generating means responsive to said first and second instructions for generating a first preliminary signal representative of said fundamental tone from said pieces of first waveform data information, said first preliminary signal being modified in the presence of said second instruction, a second preliminary signal generating means responsive to said first and second instructions for generating a second preliminary signal representative of said resonant sound from said pieces of second waveform data information and prohibited from said second preliminary signal in the absence of said second instruction, and a mixing means for mixing said first preliminary signal with said second preliminary signal for generating said electric sound signal.

2. The electronic musical instrument as set forth in claim 1, in which said first instructing means has a plurality of keys respectively assigned notes of a scale and selectively manipulated by fingers of a player, and said second instructing means is a pedal manipulated by a foot of said player for prolonging said sound.

3. The electronic musical instrument as set forth in claim 2, in which said first waveform memory and said second waveform memory further store other sets of pieces of first waveform information respectively representative of other fundamental tones and other sets of pieces of second waveform information respectively representative of other resonant sounds associated with said other fundamental tones, respectively, and said first preliminary signal generating means and said second preliminary signal generating means generate a plurality of first preliminary signals and a plurality of second preliminary signals when said player concurrently depresses a plurality of keys under a manipulation of said pedal.

4. The electronic musical instrument as set forth in claim 1, in which said first preliminary signal generating means has a first read-out circuit responsive to said first instruction for reading out said piece of first waveform data information and generating a first digital signal representative of said pieces of first waveform data information, a first envelop generator responsive to said first and second instructions for generating a series of first digital codes representative of an envelop to be imparted to said first digital signal and modifiable by said second instruction, and a first multiplier supplied with said first digital signal and said series of first digital codes for generating said first preliminary signal, said second preliminary signal generating means has a second read-out circuit responsive to said first instruction for reading out said piece of second waveform data information and generating a second digital signal representative of said pieces of second waveform data information, a second envelop generator responsive to said first and second instructions for generating a series of second digital codes representative of an envelop to be imparted to said second digital signal and modifiable by said second instruction, a second multiplier supplied with said second digital signal and said series of second digital codes for generating a third preliminary signal, a level controller responsive to said first and second instructions for generating a control signal representative of a multiplier variable between zero in the presence of said second instruction and a certain value in the absence of said second instruction, and a third multiplier supplied with said third preliminary signal and said control signal for generating said second preliminary signal.

5. The electronic musical instrument as set forth in claim 4, in which said second instruction represents a first status where said resonant sound is not contained in said sound, a second status where said resonant sound is fully contained in said sound and a third status where said resonant sound is partially contained in said sound, and said level controller supplies said control signal representative of an intermediate value between zero and said certain value when said second instruction represents said third status.

6. The electronic musical instrument as set forth in claim 5 in which said level controller varies the value of said control signal milder than the change of said second instruction between said first status, said second status and said third status.

7. The electronic musical instrument as set forth in claim 1, in which said fundamental tone has a timbre close to a timbre of a piano sound generated by striking a set of strings without manipulation of a damper pedal, and said resonant sound is close to a resonating sound generated by related strings through a resonance with said set of strings under a manipulation of said damper pedal.

8. A method for electronically generating a musical tone together with a resonant sound, comprising the steps of:

storing pieces of first waveform data information representative of a fundamental tone and produced from a first acoustic tone corresponding to said fundamental tone and generated by using an acoustic musical instrument without manipulating a resonant effect manipulator;

storing pieces of second waveform data information representative of a resonant sound and produced from a difference between said first acoustic tone and a second acoustic tone generated by using said acoustic musical instrument under manipulation of said resonant effect manipulator;

generating a first instruction for generation of a fundamental tone;

generating a second instruction for generation of a resonant sound resonating with said fundamental tone;

generating a first preliminary signal representative of said fundamental tone from said pieces of first waveform data information in response to said first and second instructions, said first preliminary signal being modified in the presence of said second instruction;

generating a second preliminary signal representative of said resonant sound from said pieces of second waveform data information, wherein said second preliminary signal is only provided when said second instruction is present; and mixing said first preliminary signal with said second preliminary signal to generate an electronic musical tone signal; and generating a sound from said musical tone signal.

9. A method as set out in claim 8, wherein said step of generating a second instruction for generation of a resonant sound is performed in response to operation of a manipulator.

10. A method as set out in claim 9, wherein the manipulator is a damper pedal.

* * * * *